US011957249B2

(12) United States Patent
Atterbury

(10) Patent No.: US 11,957,249 B2
(45) Date of Patent: Apr. 16, 2024

(54) HEADBOARD POUCH

(71) Applicant: Anthony Atterbury, Jamaica, NY (US)

(72) Inventor: Anthony Atterbury, Jamaica, NY (US)

( * ) Notice: Subject to any disclaimer, the term of this patent is extended or adjusted under 35 U.S.C. 154(b) by 0 days.

(21) Appl. No.: 18/319,792

(22) Filed: May 18, 2023

(65) Prior Publication Data

US 2023/0371702 A1 Nov. 23, 2023

Related U.S. Application Data

(60) Provisional application No. 63/343,436, filed on May 18, 2022.

(51) Int. Cl.
*A47C 21/00* (2006.01)

(52) U.S. Cl.
CPC ..... *A47C 21/003* (2013.01)

(58) Field of Classification Search
CPC ..... A47C 21/003; A47C 21/00; A47C 31/00; A47C 19/022; A47C 19/02; F21V 17/164; F21V 33/0012; F21S 9/02; F21W 2131/301; A47B 2220/0094
See application file for complete search history.

(56) References Cited

U.S. PATENT DOCUMENTS

| | | | |
|---|---|---|---|
| 1,699,853 | A | 1/1929 | Moran |
| 2,359,895 | A | 10/1944 | Burton |
| 2,448,734 | A | 9/1948 | Phillips |
| 2,896,364 | A | 7/1959 | McCollister |
| 3,062,954 | A | 11/1962 | Goolsby |
| 3,350,150 | A | 10/1967 | Schwarm |
| 3,586,847 | A | 6/1971 | Nahmias |
| 3,889,914 | A | 6/1975 | Torme |
| 5,829,787 | A | 11/1998 | Newhouse, Jr. |
| 5,913,502 | A | 6/1999 | Smith |
| 7,490,948 | B2 | 2/2009 | Fisherman et al. |
| 8,171,586 | B2 | 5/2012 | Clack |
| 8,578,528 | B1 | 11/2013 | Heare |

(Continued)

FOREIGN PATENT DOCUMENTS

WO WO-2019010403 A1 * 1/2019 ..... F02N 11/0862

OTHER PUBLICATIONS

Search English translation of WO 2019010403 A1 (Year: 2019).*
One Stop Shopping (Bed holder pockets bedside storage organizer) https://www.youtube.com/watch?v=-HFCleED98M). (Year: 2020).*

*Primary Examiner* — Omar Rojas Cadima
(74) *Attorney, Agent, or Firm* — Dunlap Bennett & Ludwig, PLLC

(57) ABSTRACT

A headboard pouch that provides easy access to reading materials and eliminates clutter from nightstands is provided. The pouch includes first and second holders, with the second holder attached to an exterior surface of the first holder. The first holder is larger than the second holder, and the first holder is intended to receive and hold reading materials, while the second holder is intended to receive and hold smartphones or like devices. The pouch includes an attachment means that releasably secures the pouch to a headboard. The pouch also includes a light attached to an articulated arm extending from a battery and power module attached to the first holder to allow the light to be manipulated into a desired angle or position. The pouch may also include a charging port in the battery and power module to allow for smartphones or like devices to be charged.

11 Claims, 3 Drawing Sheets

(56) References Cited

U.S. PATENT DOCUMENTS

| | | | | |
|---|---|---|---|---|
| 2005/0184211 | A1 | 8/2005 | Yarbrough et al. | |
| 2007/0057134 | A1 | 3/2007 | Cheng | |
| 2009/0199338 | A1* | 8/2009 | House ..... | A47C 31/00 5/503.1 |
| 2010/0288895 | A1 | 11/2010 | Shamie | |
| 2011/0126353 | A1 | 6/2011 | Veenendaal | |
| 2012/0198619 | A1 | 8/2012 | Garcia Garcia | |
| 2015/0327379 | A1 | 11/2015 | Prunty et al. | |

* cited by examiner

HEADBOARD POUCH

CROSS-REFERENCE TO RELATED APPLICATION

This application claims the benefit of priority of U.S. provisional application No. 63/343,436, filed May 18, 2022, the contents of which are herein incorporated by reference.

BACKGROUND OF THE INVENTION

The present invention relates to pouches and, more particularly, to a pouch that attaches to a headboard.

Many people like to read in bed before going to sleep. However, reading in bed with a light source from the bedside nightstand can be uncomfortable. The angle of light coming from the light source may cause the reader to strain their neck to one side to properly illuminate the book or other material they are reading. Bedside light sources often spread light over a wide area, potentially disturbing anyone else trying to sleep in the same room. Further, bedside tables are generally small with limited storage space that may not be able to fully accommodate all the items a person may wish to keep by their bedside, including a phone, a book, or other reading material.

As can be seen, there is a need for a device that provides storage for materials a person may wish to keep by their bedside while also providing light in a way that does not disturb other who are trying to sleep. The present invention solves these problems by providing a pouch that easily accommodates a book or other reading materials, provides a light by which a person may read, and a phone charger. The present invention is further attachable to a headboard for easy access to the items it may be used to hold and eliminates the clutter that can exist on a bedside nightstand.

SUMMARY OF THE INVENTION

In one aspect of the present invention, a pouch is provided, wherein the pouch comprises a first holder having a first cavity and a first opening at a first end of the first holder. The pouch further comprises a second holder coupled to an exterior surface of the first holder, the second holder including a second cavity and a second opening at a first end of the second holder. The second holder further includes a cap that covers the second opening. The first holder is more voluminous than the second holder, with the first holder being configured to receive and hold a book, while the second holder is configured to receive and hold a smartphone.

In another aspect of the invention, the pouch includes a lighting assembly coupled to an exterior surface of the first holder and configured to illuminate reading material, such as a book. The lighting assembly comprises a battery and power module housed within a protective covering coupled to the first holder. The battery and power module includes a power switch, at least one phone charging port, and at least one charging port. The battery and power module may be powered by an AC adapter via an electrical cable connected to the at least one charging port. The light assembly further includes a light attached to a first end of an elongate articulated arm, with the second end of the articulated arm attached to the battery and power module.

In another aspect of the invention, the pouch comprises at least one attachment means configured to releasably secure the pouch to an upright structure, such as a headboard. The at least one attachment means may comprise a plurality of malleable wire hooks that are coupled to the pouch proximal to the first opening in the first holder.

These and other features, aspects and advantages of the present invention will become better understood with reference to the following drawings, description, and claims.

DETAILED DESCRIPTION OF THE INVENTION

Figure 1:
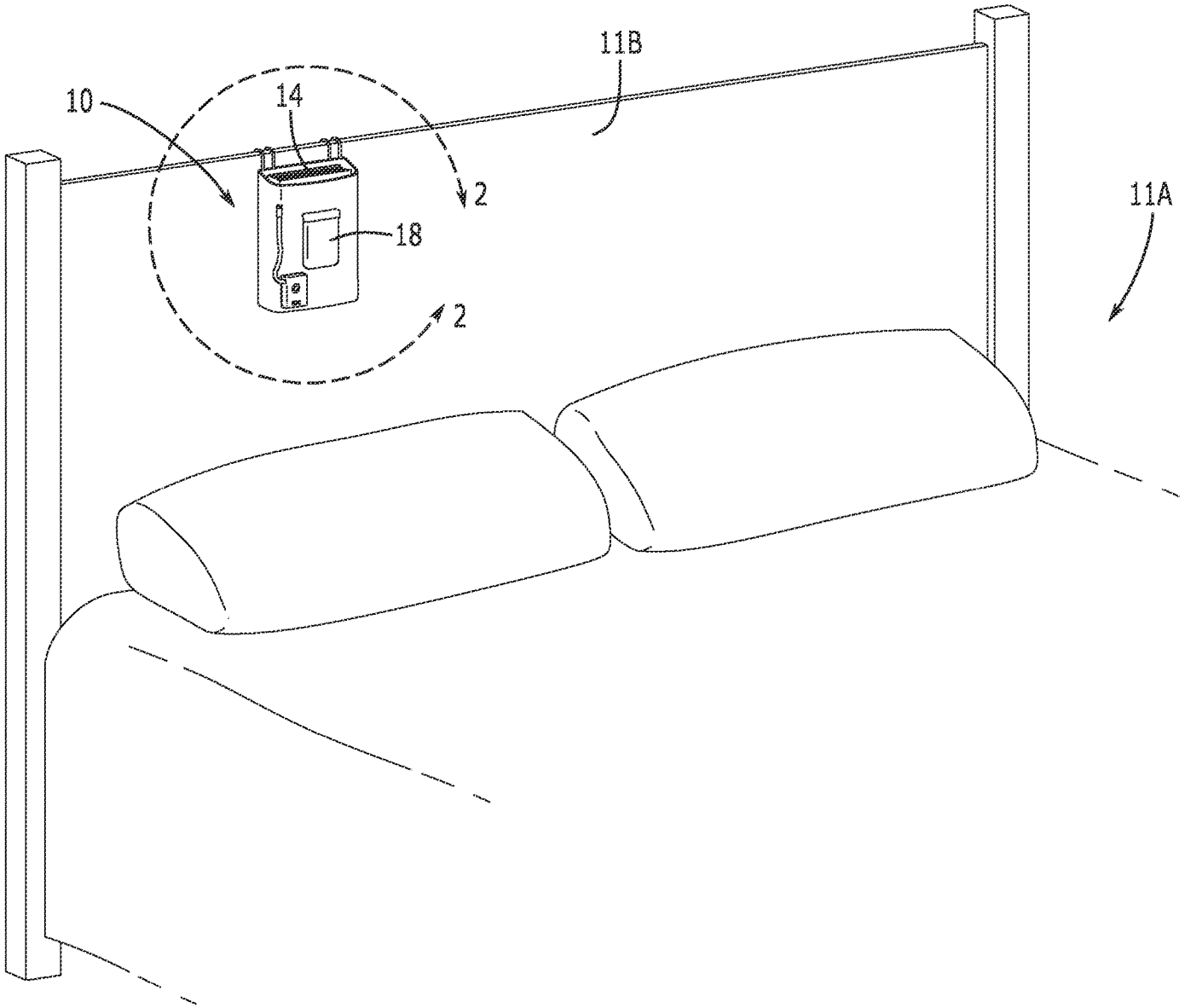
FIG. 1 is a front perspective view of an embodiment of a headboard pouch in accordance with the present invention.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a pouch that includes a first holder having a first cavity and a first opening, the first opening configured to allow a book or similarly sized object to be inserted into and held in the first cavity. The pouch includes at least one attachment means proximal to the first opening and configured to secure the pouch to a headboard or similar structure. The at least one attachment means may also be flexible and adjustable to accommodate differing sizes or shapes of headboards to which the pouch may be attached.

The pouch may further include a second holder attached to an exterior surface of the first holder and having a second opening at one end of the second holder. The second holder includes a second cavity configured to hold a smartphone or similarly sized object. The second holder further includes a cap element attached to the exterior surface of the first holder adjacent to the second opening such that the cap element covers the second opening.

The pouch includes a light assembly attached to the exterior surface of the first holder. The light assembly includes a protective cover attached to the exterior surface, the protective cover housing a power and battery module. The power and battery module includes a power switch, at least one phone charging port configured to cooperate with a cable capable of charging phones, and at least one charging port configured to cooperate with an electrical cord and AC adapter, the AC adapter being able to connect to an electrical outlet to charge the power and battery module. The protective cover includes openings located to align with each of the power switch, at least one phone charging port, and at least one charging port.

Further, the light assembly includes a light connected to the power and battery module via an elongate flexible arm that passes through a corresponding opening in the protective cover. The elongate flexible arm is configured to allow the light to be moved into and set at any position or angle within the reach of the arm desired by the reader.

The present invention thus provides a place to store books or other reading materials in an easily accessible position while also providing a light source that sufficiently lights reading materials for easy reading without disturbing others who may be trying to sleep. The present invention also helps to keep bedside tables and nightstands clutter free, thereby helping keep a person's bedroom tidy and clean.

It should be noted that the materials of manufacture for the present invention are not particularly limited. For example, the pouch may be constructed of any material that can is strong enough to hold a book or other similarly weighted objects but light enough to be easily placed onto a headboard, such as fabrics or plastics.

It should be further noted that the method of manufacture for the present invention is not particularly limited. For example, the first holder and second holder may be coupled together by known means, such as by sewing or use of adhesives.

Figure 2:
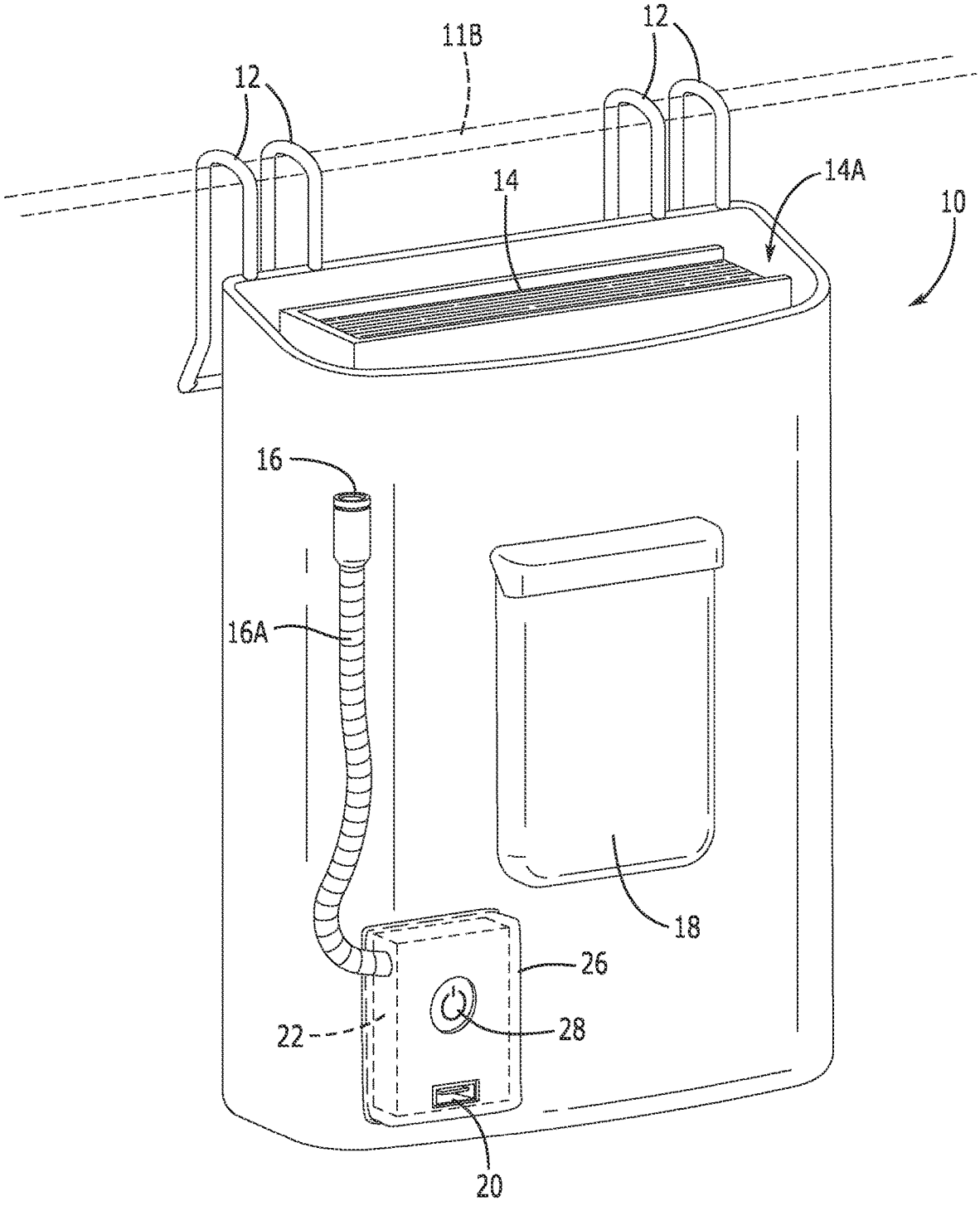
FIG. 2 is a detail perspective view thereof, as indicated by line 2-2 of FIG. 1.
Figure 3:
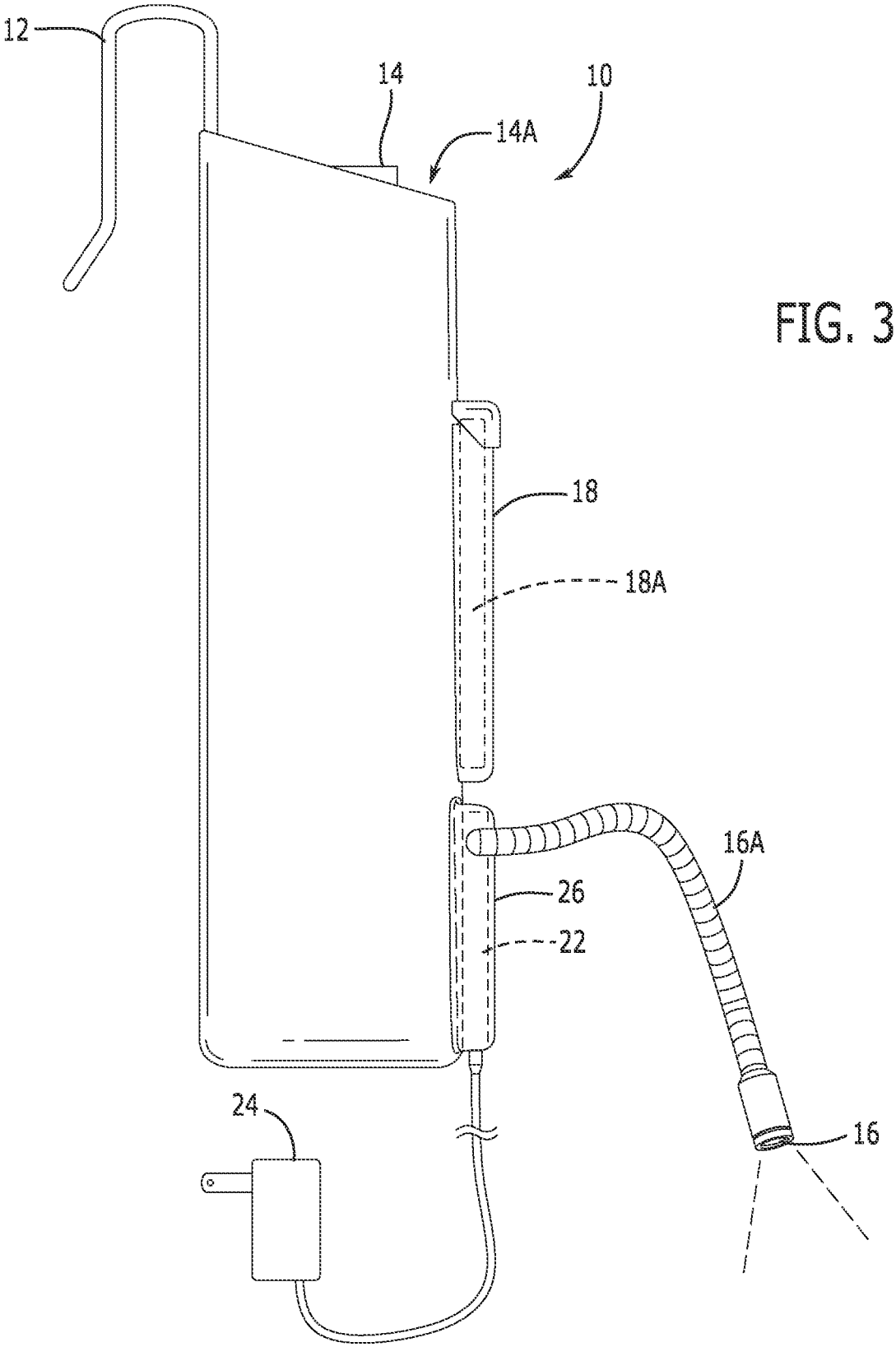
FIG. 3 is a detail side elevation view thereof.

Referring to FIGS. 1-3, an embodiment of a pouch in accordance with the present invention is shown. The pouch 10 is configured to be attached and secured to a headboard 11B of a bed 11A. The pouch 10 includes a first holder 14A that includes a first cavity and a first opening, wherein the first cavity and opening cooperate to receive and hold a book 14 or similarly sized object. The pouch includes at least one attachment means 12, such as hooks 12, proximal to the first opening and configured to secure the pouch 10 to the headboard 11B. The at least one attachment means 12 may further be flexible and adjustable to accommodate differing sizes or shapes of headboards to which the pouch 10 may be attached. For example, the hooks 12 may be formed of malleable wire, such as a steel wire, that may be bent to accommodate a contour of the headboard 11B so that the pouch 10 is securely but releasably held against the headboard 11B.

The pouch 10 may further include a second holder 18 attached to an exterior surface of the first holder 14A and having a second opening at one end of the second holder. For example, the second holder 18 may be placed on a portion of the exterior surface of the first holder 14A that is on an opposing side of the first holder 14A relative to the at least one attachment means 12, such that the second holder 18 and its contents are easily accessible. The second holder 18 includes a second cavity configured to hold a smartphone 18A or similarly sized object. The second holder 18 further includes a cap element attached to the exterior surface of the first holder 14A adjacent to the second opening such that the cap element covers the second opening, as best seen in FIGS. 2 and 3. The second holder thus provides a protected pouch for smartphones that is easily accessible.

The pouch 10 includes a light assembly attached to the exterior surface of the first holder 14A. The light assembly includes a protective cover 26 attached to the exterior surface of the first holder 14A, wherein the protective cover 26 houses a power and battery module 22, such a miniature CPU or microprocessor. The power and battery module 22 includes a power switch 28, at least one phone charging port 20, such as a universal serial bus (USB) port, and at least one charging port configured to cooperate with an electrical cord and AC adapter 24, as best seen in FIGS. 2 and 3. The power and battery module 22 may thus be charged through the AC adapter 24, charge a phone 18A with the at least one phone charging port 20, and be easily be turned on or off with the power switch 28. The protective cover 26 includes openings aligned with each of the power switch 28, at least one phone charging port 20, and at least one charging port to provide easy access to a user.

Further, the light assembly includes a light 16 connected to the power and battery module 22 via an elongate and flexible articulated arm 16A that passes through a corresponding opening in the protective cover 26. The articulated arm 16A is configured to allow the light 16 to be moved into and set at any position or angle within the reach of the articulated arm 16A as desired by the user. The light 16 and articulated arm 16A are sized to be unobtrusive and easily manipulated by the user, and the light 16 is configured to produce a concentrated light source that illuminates only the desired reading material. For example, the light 16 and articulated arm 16A may be sized to have a substantially pen-sized diameter.

The present invention thus provides a pouch that provides easy access to reading materials to an individual in their bed, as well as a light source that provides illumination for reading materials that doesn't disturb others. The present invention also provides extra storage for materials that would otherwise create clutter on a bedside table, thereby helping to keep a person's bedroom tidier.

It should be understood, of course, that the foregoing relates to exemplary embodiments of the invention and that modifications may be made without departing from the spirit and scope of the invention as set forth in the following claims.

What is claimed is:

1. A pouch comprising:

a first holder having a first cavity and a first opening at a first end of the first holder;

a second holder coupled to an exterior surface of the first holder at a first location, the second holder including a second cavity and a second opening at a first end of the second holder;

a protective covering coupled to the exterior surface of the first holder at a second location;

a lighting assembly, a portion of the lighting assembly being positioned within the protective covering, wherein the lighting assembly is configured to illuminate reading material; and at least one attachment means configured to releasably secure the pouch to an upright structure, the at least one attachment means coupled to the pouch proximal to the first opening in the first holder.

2. The pouch of claim 1, wherein the first holder is more voluminous than the second holder.

3. The pouch of claim 2, wherein the first holder is configured to receive and hold a book, and the second holder is configured to receive and hold a smartphone.

4. The pouch of claim 1, wherein the second holder includes a cap that covers the second opening.

5. The pouch of claim 1, wherein the lighting assembly further includes a battery and power module housed within the protective covering, and the protective covering is coupled to a front, exterior surface of the first holder.

6. The pouch of claim 5, wherein the lighting assembly further includes an elongate articulated arm.

7. The pouch of claim 6, wherein a light is attached to a first end of the elongate articulated arm, and a second end of the elongate articulated arm is attached to the battery and power module.

8. The pouch of claim 5, wherein the battery and power module includes at least one phone charging port.

9. The pouch of claim 1, wherein the at least one attachment means comprises a plurality of malleable wire hooks.

10. The pouch of claim 1, wherein the upright structure is a headboard.

11. A pouch comprising:

a first pocket having a first cavity and a first, single opening at a top end of the first pocket;

a second pocket coupled to a front, exterior surface of the first pocket, the second pocket including a second cavity and a second, single opening at a top end of the second pocket;

a protective cover coupled to the front, exterior surface of the first pocket;

a lighting assembly comprising a base and a flexible arm, the base being positioned within the protective cover and configured to illuminate reading material; and at least one hook coupled to the first pocket proximal to the first, single opening, wherein the at least one hook is configured to releasably secure the pouch to an upright structure.

* * * * *